US006161508A

United States Patent [19]

Lindblad

[11] Patent Number: 6,161,508

[45] Date of Patent: Dec. 19, 2000

[54] VALVE SYSTEM IN A ROTARY RADIAL-PISTON ENGINE

[75] Inventor: Karl-Erik Lindblad, Alingsås, Sweden

[73] Assignee: Kesol Production AB, Alingsås, Sweden

[21] Appl. No.: 09/155,791

[22] PCT Filed: Mar. 21, 1997

[86] PCT No.: PCT/SE97/00479

§ 371 Date: Feb. 22, 1999

§ 102(e) Date: Feb. 22, 1999

[87] PCT Pub. No.: WO97/37114

PCT Pub. Date: Oct. 9, 1997

[30] Foreign Application Priority Data

Apr. 3, 1996 [SE] Sweden ..... 9601301

[51] Int. Cl.[7] ..... F02B 57/10

[52] U.S. Cl. ..... 123/44 B

[58] Field of Search ..... 123/44 R, 44 B

[56] References Cited

U.S. PATENT DOCUMENTS 686,801 11/1901 Box et al. ..... 123/44 B
951,388 3/1910 Conill ..... 123/44 B
1,990,660 2/1935 McCann ..... 123/44 B
5,357,911 10/1994 Lindblad .

FOREIGN PATENT DOCUMENTS 1481842 8/1977 United Kingdom .
9006424 6/1990 WIPO .

*Primary Examiner*—Michael Koczo

[57] ABSTRACT

The invention concerns a radial-piston engine of rotary type of the kind having a valve system comprising apertured disc rings arranged in intersliding relationship, one of said rings being stationary while the other one is arranged to take part in the rotary motion of the rotor. The valve opening relationship is determined by the manual angular positions of the discs. In accordance with the invention, filed injection takes place via an injection nozzle positioned in the stationary disc. The valve ring is formed with a through opening which in response to the position assumed my the rotor at the moment of fuel ignition forms an open communication means between the injection nozzle and the combustion chamber.

8 Claims, 5 Drawing Sheets

Figure 1:
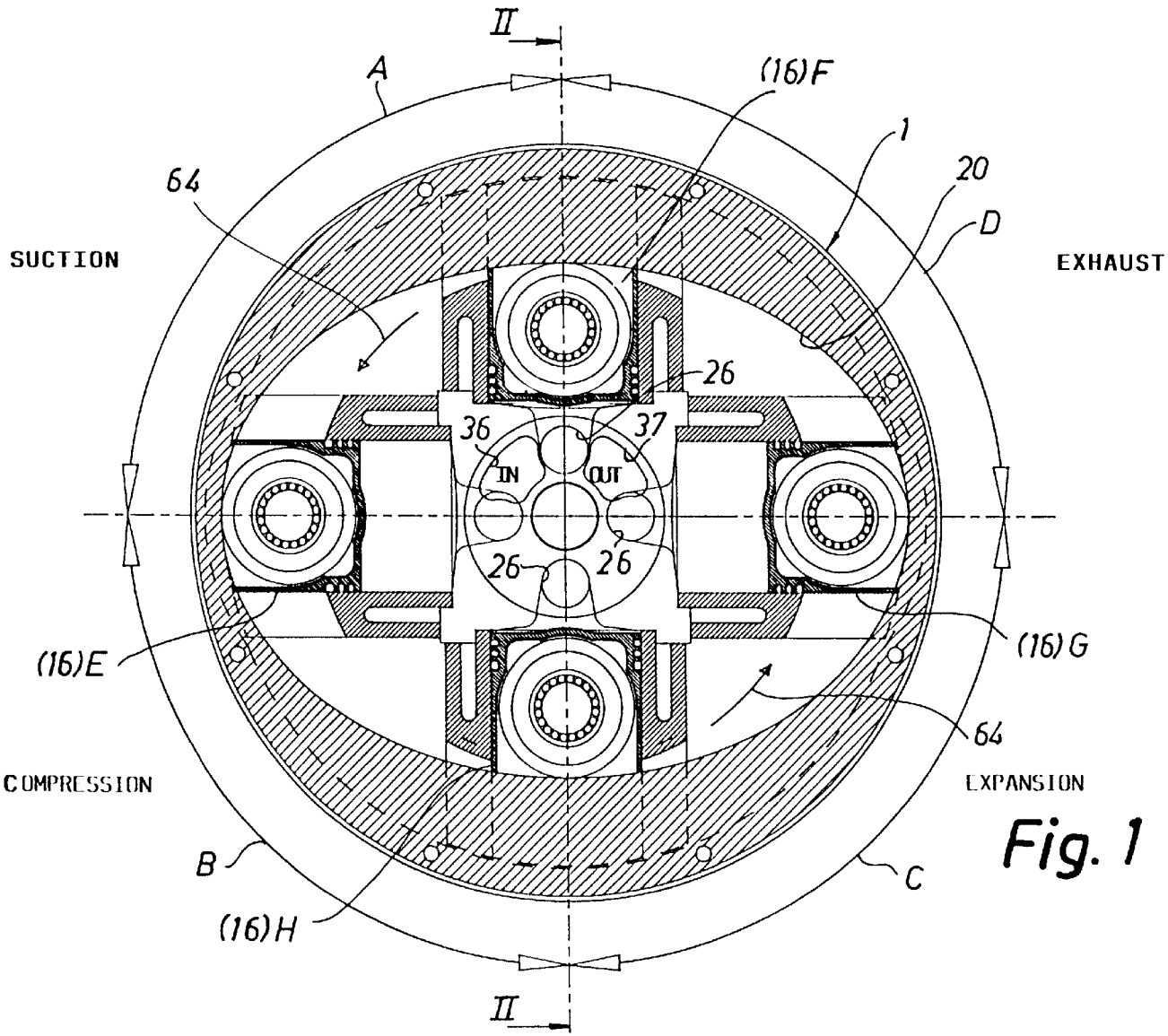

31
30
63
37
36
26
28
29
32
31
33

VALVE SYSTEM IN A ROTARY RADIAL-PISTON ENGINE

The present invention relates to a device in a rotary radial-piston engine of the kind defined in the preamble of Claim 1.

A radial-piston engine of this kind is described e.g. in Applicant's U.S. Pat. No. 5 357 911 and PCT/SE95/00149. The radial-piston engine described therein is a four-stroke engine comprising a stationary housing, a drive shaft which is rotationally mounted essentially centrally inside said housing and which supports a hub co-rotating therewith, radially projecting cylinders which are mounted on the hub for rotation therewith, said cylinder being positioned inside a circumferentially extending chamber in said housing and each receiving a piston which is mounted for radial reciprocating movement therein, the piston heads of said pistons facing radially inwards towards the hub, a circumferentially extending guide cam, said cam being mounted inside the housing in alignment with the pistons adjacent the radially outwardly directed piston ends and having a cam face facing said pistons, bearing means mounted on each piston abutting against said cam face in order to impart a radial movement to said pistons in the direction towards the hub upon rotation of the rotary unit formed by the pistons, the cylinders, the hub, and the drive shaft, relative to the stationary housing, and combustion chambers formed in said hub essentially in alignment with the heads of the respective pistons, each combustion chamber having valve-operated inlets/outlets for intake and exhaustion, respectively, of a gas taking part in the combustion an of combusted exhaust gases, respectively, so as to impart a radial movement to said pistons in a direction away from the hub in response to the pressure increase upon combustion and to the centrifugal force, said inlets/outlets to and from, respectively, each combustion chamber being formed axially in a valve ring which co-rotates with the hub and which is essentially concentric therewith, said valve ring sealingly abutting against a stationary port ring which is essentially concentric with the valve ring and which is connected to the housing, said port ring being formed with axial intake and exhaust ports communicating with inlet and outlet ducts and arranged, upon rotation of said rotary unit relative to the housing, to alternatingly assume a position in alignment with that inlet/outlet in the valve ring that is associated with the respective combustion chamber.

The object of the invention is to improve the combustion efficiency even further, with resulting fuel-consumption savings as well as reduced effects on the environment.

This object is obtained in a device in accordance with the invention which is essentially characterized in that an injection duct extends through the port ring, one end of said duct being connected to an injection pump system and the opposite end of said duct, which is positioned in said port ring, debouching, via an injection nozzle, into the combustion chamber at a point in close proximity to the place where the combustion chamber, disposed in said rotor, is positioned upon ignition of the combustion gas, and in that said valve ring has a through opening which in said position of the rotor forms an open communication means between the injection nozzle and the combustion chamber.

Figure 2:
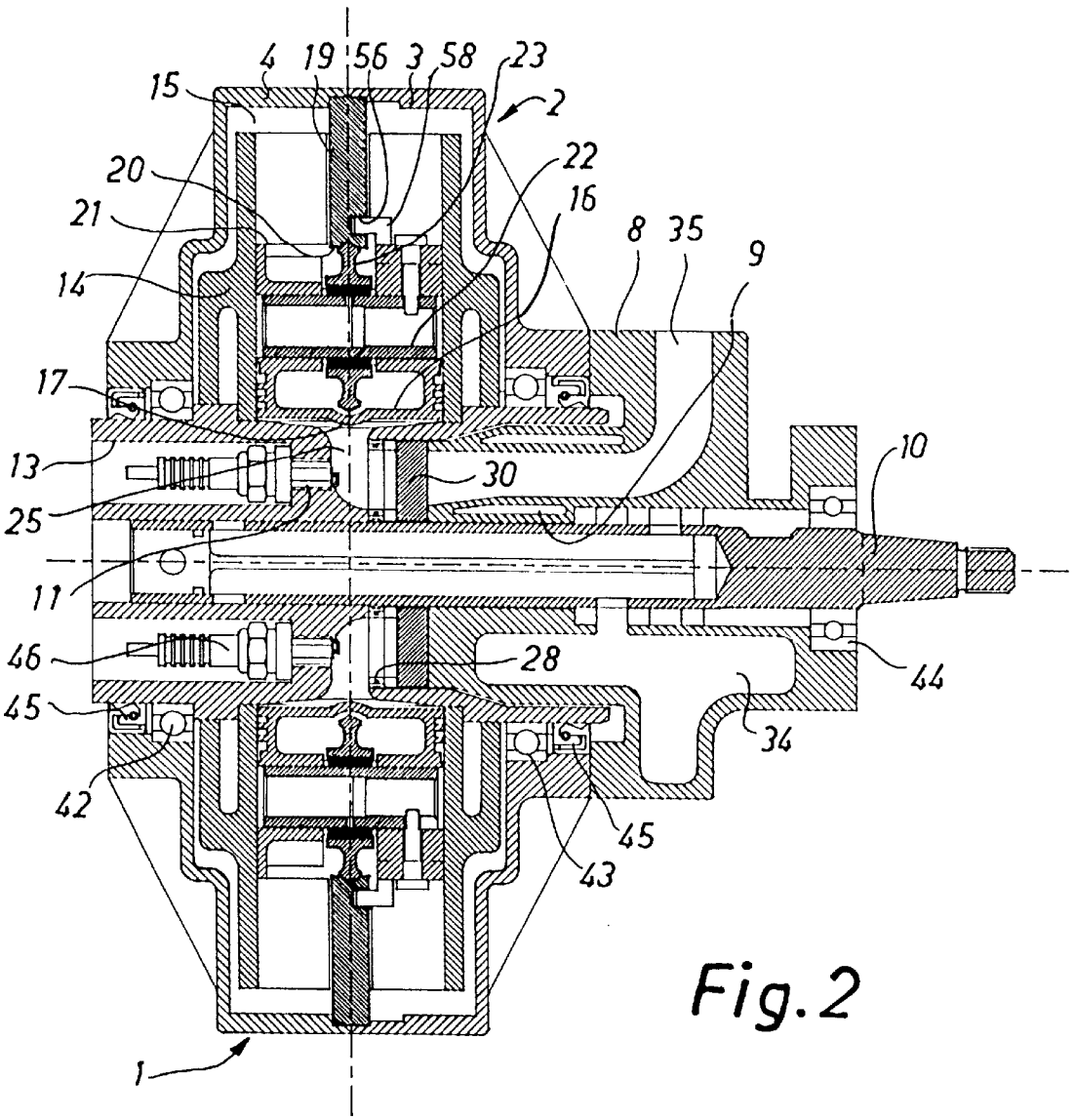
Figure 3:
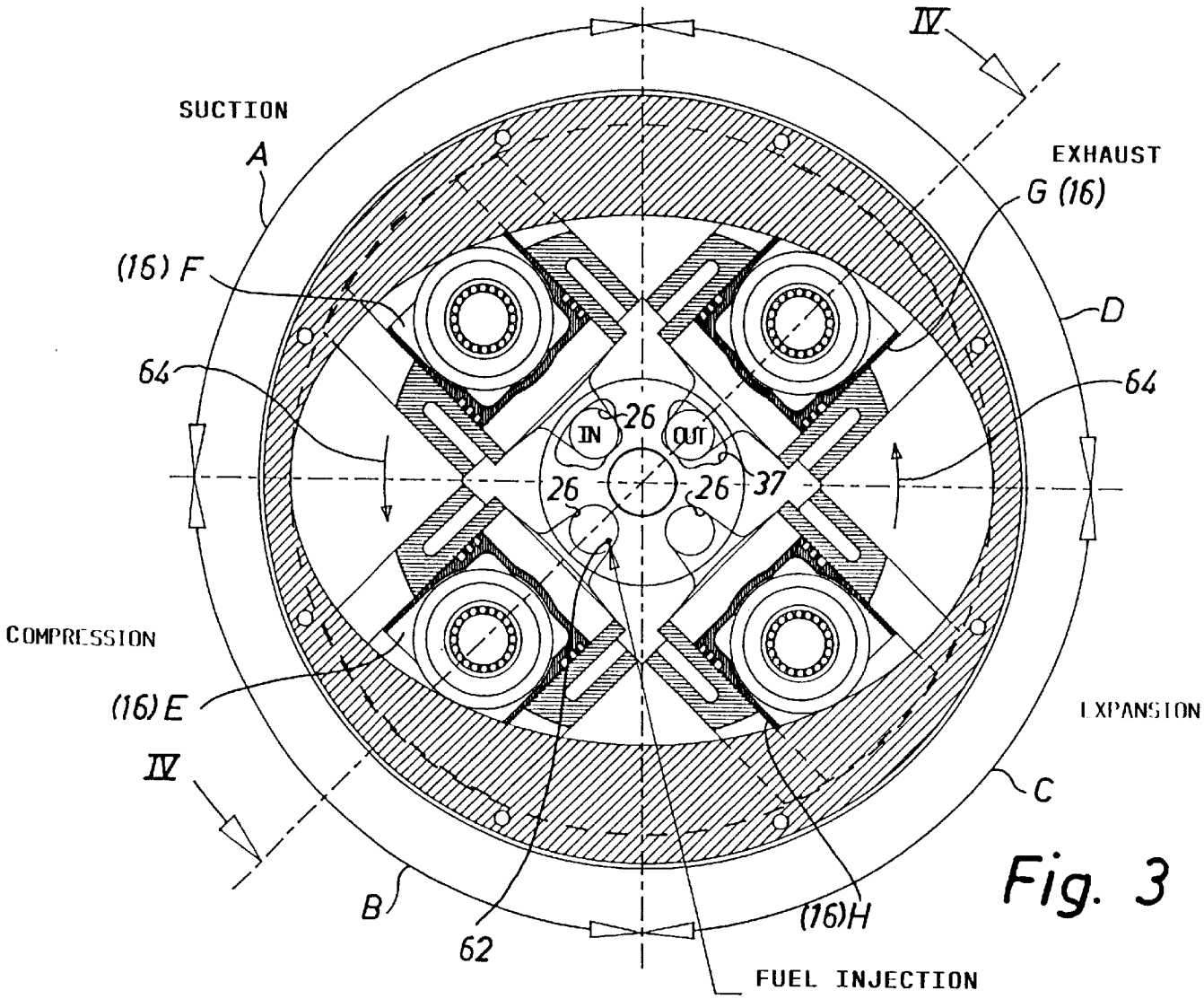
Figure 4:
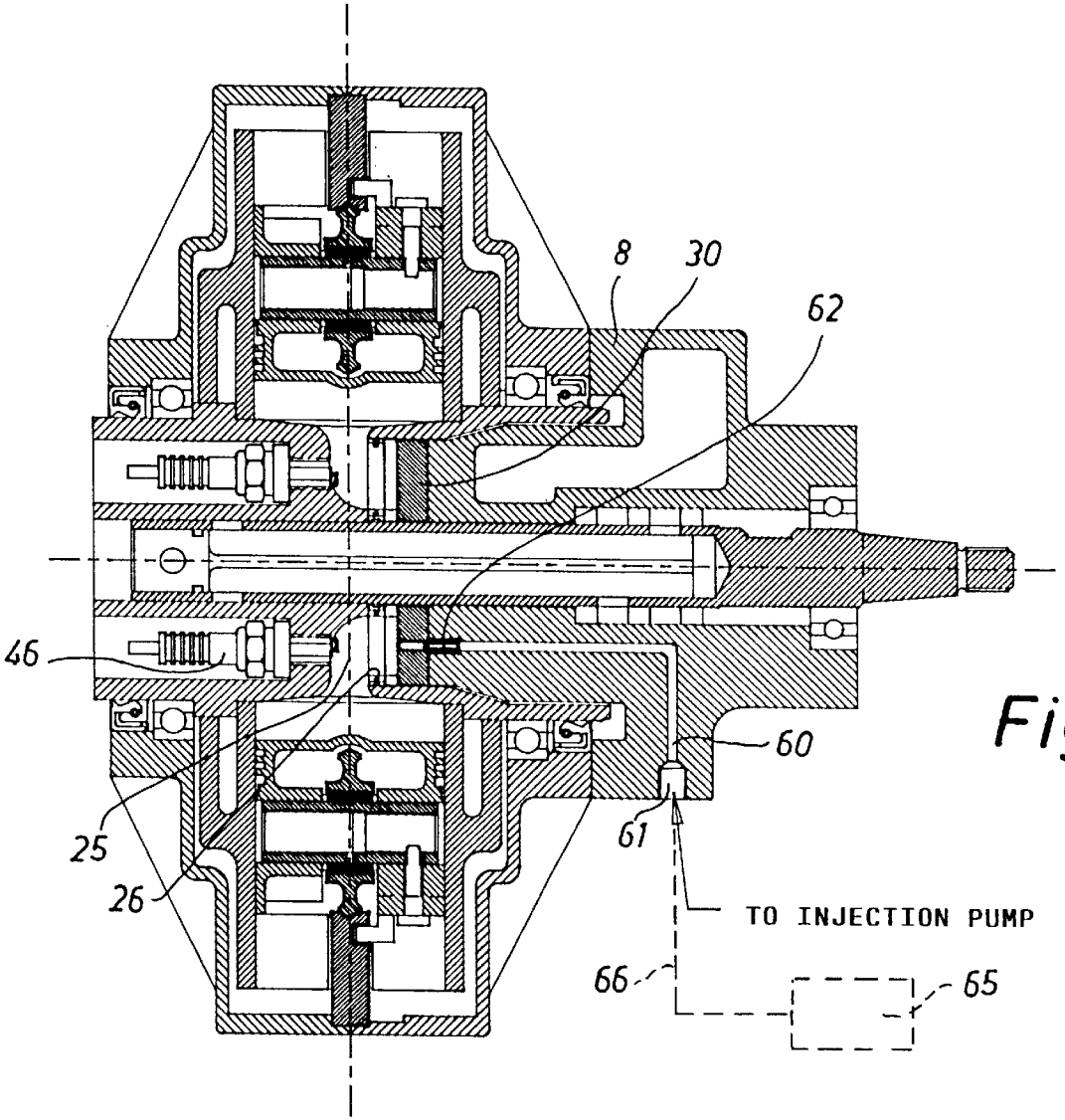
Figures 5, 5A, 5B:
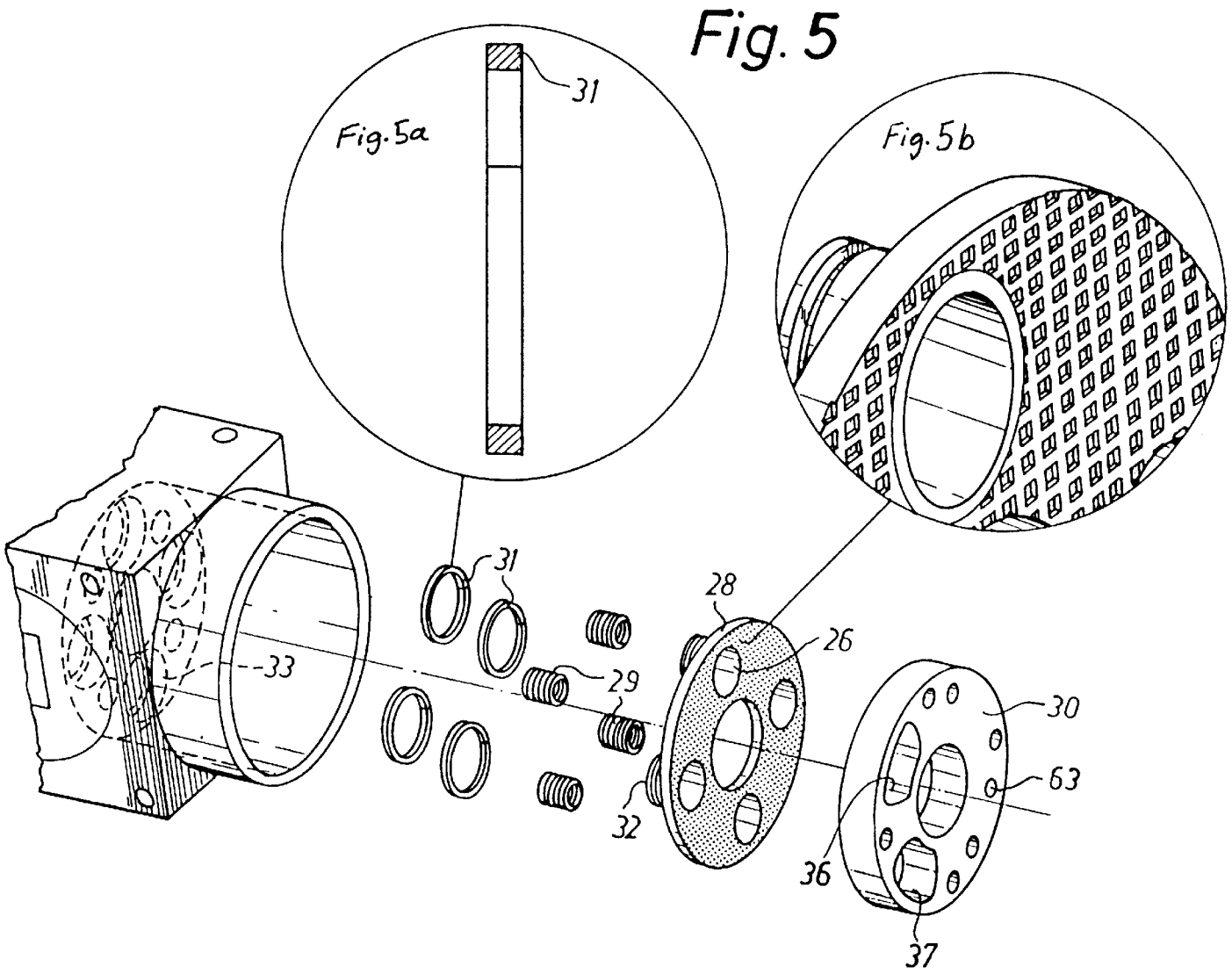

The invention will be described in closer detail in the following with reference to the accompanying drawing illustrating a presently preferred embodiment thereof. In the drawings:

FIG. 1 is a cross-sectional view through an engine in accordance with the subject invention, being shown air a first operative position, FIG. 2 is a longitudinal section through the same engine taken on line II—II of FIG. 1, FIG. 3 illustrates the engine in a second operative position thereof, FIG. 4 is a longitudinal section taken on line IV—IV of FIG. 3, and FIG. 5 is an exploded view of a valve system incorporated in the device.

FIG. 5*a* is an enlarged side view of a sealing ring,

FIG. 5*b* is an enlarged view of a valve ring.

The engine illustrated in the drawings is a four-stroke internal combustion engine pertaining to the group of multiple cylinder radial-piston engines. The internal combustion engine is indicated generally by numeral reference 1 and it comprises a stationary, essentially rotationally symmetrical or annular housing 2. The stationary housing 2 is made from a suitable material, such as cast iron or light metal and it consists of two halves or housing parts 3 and 4, which are held together by means of bolts or the like, not shown, arranged circularly adjacent the external periphery of the housing. To seal off the two housing parts 3, 4 from one another a peripheral seal, such as an O-ring, preferably is provided.

On one of the parts of the stationary housing 2, in accordance with the shown embodiment housing part 3, is securely anchored a connection collar 8 having a central through bore 9 for reception therein of a drive shaft 10, the latter being mounted for rotary motion essentially air the center of the housing 2. A hub 11 which co-rotates with the drive shaft 10 is mounted on the drive shaft an is formed with axially extending, sleeve-like extensions 13.

The rotary unit formed by the drive shaft 10, the hub 11, the cylinders 14, and the pistons 16 is rotationally mounted inside the stationary housing 2 and in the connection collar 8 by means of roller bearings 42, 43, 44, two of said bearings, namely. Bearings 42, 43, being positioned between the sleeve-like extensions 13. the hub 11 and the stationary housing 2 whereas the this bearing 44 is positioned between the drive shaft 10 and the connection collar 8 adjacent: the free projecting end of the shaft 10 to which end a power take-off means may be connected. The bearings 42, 43 may be provided with suitable seal rings 45, positioned axially externally thereof.

Radially projecting cylinders 14, in the number of four in accordance with the embodiment illustrated in tt drawings, are non-rotationally mounted on the hub 11 so as to rotate together with the latter. All cylinders 14 are positioned inside a circumferentially extending chamber 15 in the stationary housing 2, i.e. a chamber defined by housing parts 3 and 4. In each cylinder 14 is received an associated piston 16 for reciprocating movement radially therein, said pistons 16 being of an essentially conventional configuration including piston heads 17 and sealing rings, the piston heads facing radially inwardly, towards the hub 11.

A circumferentially extending cam 19, the cam face 20 of which faces the pistons 16, is mounted inside the stationary housing 2 opposite the pistons 16 at the radially outwardly projecting piston ends 21. More specifically, the circumferential cam 19 is clamped inside recesses formed in opposed faces of the housing parts 3 and 4. Optionally, the cam is secured in position by means of the same bolts as those holding the housing parts together. In accordance with the illustrated embodiment which concerns a four-cylinder internal combustion engine, the cam face 20 is essentially of elliptical configuration, as indicated e.g. in FIGS. 1 and 3, but the configuration of the cam surface may vary depending on the number of cylinders used.

Via a piston bolt 22, each piston 16 supports a bearing 23, the outer ring of which rolls in abutment against the cam face 20 in order to impart a radial motion to the pistons 16 in a direction towards the hub 11, when the rotary unit formed by the pistons 16, the cylinders 14, the hub 11, and the drive shaft 10 rotates relative to the stationary housing 2.

In the hub 11, essentially opposite the heads 17 of the respective pistons 16, is formed an essentially radially inwardly directed trough-like combustion chamber 25, having axially directed inlets and outlets 26 for intake of a combustible fuel-air mixture and exhaust of exhaust gases, respectively. In this manner, the pistons 16 are imparted a radial movement in the direction away from the hub 11 in response to the pressure increase resulting from the combustion and the centrifugal force acting on the pistons.

More precisely, the inlets and outlets 26 leading to and from, respectively, each combustion chamber 25, are common and they are formed axially in a valve ring 28 which co-rotates with the hub 11 and which is essentially concentric with the latter. The valve ring 28 abuts flatly against a port ring 30, being yieldingly pressed into sealing abutment against said ring 30 by means of compression springs 29, and it supports sealing rings 31 around its inlets/outlets 26. In accordance with the embodiment shown the inlets/outlets 26 in the valve ring 28 are prolonged axially and in the form of sleeves 32 they project outwardly from the valve ring 28, said sleeves 28 extending into corresponding recesses 33 formed in the hub 11, for the purpose of securing and displacing the valve ring, and supporting the sealing ring 31.

The port ring 30 is essentially concentric with the valve ring 28 and it is rigidly connected to the stationary housing 2. More precisely, by means of bolts, not shown, it is mounted on the inner end of the connection collar 8 which is turned towards the combustion chambers 25. The port ring 30 is formed with axial intake/exhaust ports 36 and 37 communicating with inlet and outlet ducts 34 and 35 in the connection collar 8. The intake and exhaust ports 36, 37 are arranged, upon rotation of the rotary unit 10, 11, 14 and 16 relative to the stationary housing 2, alternatingly to assume a position in register with that inlet/outlet 26 in the valve ring 28 that pertains to the combustion chamber 25 in question.

The inlet and outlet ducts 34 and 35 formed in the connection collar 8 debouch at once of their ends axially opposite the intake and exhaust ports 36 and 37, respectively, in the port ring 30 and at their opposite ends they are connected to an intake system, such as an air compressor, and to an exhaust system, respectively.

Into the inlet duct 34 preferably debouches a further duct, not shown, the opposite end of which debouches into the circumferentially extending chamber 15 to bring the chamber 15 into a subpressurized condition, thus to extract any blow-by exhaust gases and, at least at low engine speed, to facilitate the radial motion outwards of the pistons 16.

In accordance with the shown embodiment the radial-piston engine likewise is fitted with one spark plug 46 for each combustion chamber 25, i.e. with four spark plugs in accordance with the embodiment shown. The spark plugs are essentially axially screwed into the hub 11 opposite the valve ring 28, and consequently they rotate together with the hub. Thus, the electrode end of each spark plug projects into the associated combustion chamber 25 essentially opposite the common inlet/outlet 26 in the valve ring 28.

At their connective ends, the spark plugs 46 preferably are associated in a manner known per se to e.g. an ignition distributor.

To urge the pistons 16 radially outwardly, at least when the internal combustion engine is started and/or operates at low rotational speeds, a circumferentially extending return cam 56 is mounted in the circumferentially extending chamber 15 of the stationary housing 2. Each piston is formed with a hook-shaped return member 58 which cooperate; with the return cam 56 and which is arranged to move into abutment against the cam faces of the return cam 56 in order to urge the pistons radially outwardly as mentioned above to prevent them from assuming an oblique position inside their associated cylinder 14.

For the sake of completeness it should also be mentioned that the radial-piston engine as described above likewise is fitted with a water cooling system and with a lubricating system, but since these systems form no part of the invention as such they are not described further herein.

It should also be mentioned that the radial-piston engine as shown and described comprises four cylinders but there is nothing to prevent this number to be reduced to at least two or increased to perhaps six or more cylinders.

Furthermore, in FIG. 4 reference number 60 designates an injection duct formed in the connection collar 8 and the mouth 61 of which is arranged to be connected to an injection pump via a channel system or the like. The pump may be of a conventional type and therefore need not be described further herein. Numeral reference 62 designates an injection nozzle disposed adjacent to the port ring 30 and, in accordance with the shown embodiment, it is directed axially towards the end, i.e. the electrodes on the spark plug 46 that momentarily is in position to ignite the gas mixture present in the combustion chamber 25. In this situation the opening 26 of the valve ring is positioned in front of the injection nozzle, thus affording free passage of the injected fuel to the place where the ignition is to start, i.e. in the subject case at the spark plug electrodes. Because the fuel injection occurs at the very place where the ignition is to start, the fuel admixture into the air in the rest of the combustion chamber may be kept at a minimum, i.e. the mixture may be kept very lean without jeopardizing the ignition. At the place of ignition, the fuel admixture may be rich, as required to ensure satisfactory ignition whereas in the other parts of the combustion chamber no unnecessarily rich fuel admixture takes place. Numeral reference 63 designates in FIG. 5 the place of position of the injection nozzle 62 in the port ring.

Arrows drawn in FIGS. 1 and 3 externally of the periphery of the engine indicate the various engine strokes, i.e. arrow A indicates the suction stroke, arrow B the compression stroke, arrow C the expansion stroke and arrow D the exhaust stroke. The direction of rotor movement in operation is indicated by arrows 64.

The function of the radial-piston engine described in the aforegoing will be briefly discussed below, the pistons of engine 4 being designated in FIGS. 1 and 3 by E, F, G, and H for the sake of simplicity.

In FIGS. 1 and 2, piston F is depicted in impending suction position for suction of a gas mixture, i.e. the opening 26 of the valve ring is about to enter the area of the suction port. In FIG. 3 the valve ring port 26 of piston F has reached a position wherein it is wholly in register with suction port 36. Upon further movement to the position of piston E shown in FIG. 3, the compression stroke begins, during which the valve ring opening 26 is completely closed towards the plane of sliding motion of the port ring. In the position of piston E shown in FIG. 3, the injection valve 62 has just reached the area of the valve ring opening 26. During the continued movement, to the position illustrated by piston H in FIG. 1, the injection nozzle is exposed to the combustion chamber, allowing fuel to be injected thereinto.

Preferably, the injection is effected as a scattered jet, which causes efficient mixture of fuel and air, particularly in the vicinity of the place from which the ignition starts. The injection valve preferably is spring-biased and opens in response to pressure increase in the duct 60. The pressure increase is effected by means of a suitable injection pump, which is indicated in FIG. 4 by means of broken lines and is designated by reference 65. Numeral reference 66 designates the line connection leading from the injection pump 65 to the duct 60. When the gas mixture is ignited, the expansion forces the piston past the position represented in FIG. 3 by piston A, to the position illustrated in FIG. 1 by piston G. During this movement the connection vla the valve ring hole 26 is interrupted. On account of the mass inertia, the rotary motion continues beyond the position represented in FIG. 1 by piston G, to the position represented in FIG. 3 by the same piston, in which position the valve ring opening 26 is in register with the exhaust port 37. On account of the movement inwards of the piston, combusted gases are forced out through the exhaust port 37 to the exhaust system of the engine. Upon continued rotation, the outlet port is closed, when the piston reaches the position represented in FIG. 1 by piston F, whereupon new suction of air etcetera may be effected again, and so on.

All four pistons 16 sequentially perform all four strokes during one revolution of the rotating unit 10, 11, 14, 16.

The invention obviously must not be regarded as limited to the presently most preferred embodiment described and illustrated herein merely as an example, but could be modified in many ways within the scope of the claimed patent protection.

The invention has, for instance, been described herein in connection with an engine fitted with spark plugs but could equally well be applied in an engine wherein the ignition occurs merely as a result of compression heat, for instance an engine of diesel type In the illustrated embodiment the usual suction-exhaust port 26 is used as the passage for the fuel from the injection nozzle, but it is of course also possible to provide such fuel passage via a separate port intended for the purpose formed in the valve ring and e.g. being radially displaced relative to the port 26 described above. It is likewise possible for the four piston strokes to be performed over half the revolution or even over a smaller part of the revolution. This result could be obtained by adaptation of the cam curvature configuration accordingly and by arranging the ports in the port ring as well as in the injection nozzle in positions suitable for the each four-stroke cycle. This means e.g. doubling the number of port ring ports, should the revolution comprise two cycles.

What is claimed:

1. A device in a rotary radial-piston engine comprising a stationary housing (2), a drive shaft (10) which is rotationally mounted substantially centrally inside said housing and which supports a hub (11) co-rotating therewith, at least two radially projecting cylinders (14) which are mounted on the hub (11) or rotation therewith, said cylinders (14) forming, together with the hub (11) and the drive shaft (10), a rotary unit which is rotatable relative to the stationary housing (2), and a combustion chamber (25) formed in said hub (11), said combustion chamber having valve-operated inlets/outlets (26) for intake and exhaustion, respectively, of a gas, taking part in the combustion, and of combusted exhaust gases, said inlets/outlet (26) to and from, respectively, each combustion chamber (25) being formed axially in a valve ring (28) which co-rotates with the hub (11) and which is substantially concentric therewith, said valve ring (28) sealingly abutting against a stationary port ring (30) which is substantially concentric with the valve ring and which is connected to the housing (2), said port ring (30) being formed with axial intake and exhaust ports (36, 37) communicating with inlet and outlet ducts (34, 35) and arranged, upon rotation of said rotary unit (10, 11, 14, 16) relative to the housing (2), to alternatingly assume a position in alignment with that inlet/outlet (26) in the valve ring (28) that pertains to the respective combustion chamber (25), said valve ring (28) bearing against said port ring (30), wherein an injection duct (60) extends through the port ring (30), one end of said duct being connected to an injection pump system (65) and the opposite end of said duct, which is positioned in said port ring, debouching, via an injection nozzle (62), hint the combustion chamber at a point in close proximity to the place where the combustion chamber, disposed in said rotor, is positioned upon ignition of the combustion gas, and in that said valve ring (28) has a through opening (26) which in said position of the rotor forms an open communication means between the injection nozzle (62) and the combustion chamber (25).

2. A device as claimed in claim 1, wherein said through opening (26) is the inlet/outlet openings of the rotating valve ring (28).

3. A device as claimed in claim 1, wherein the engine is a spark plug engine having spark plugs (46) arranged on the rotor, the injection nozzle (62) is arranged to direct the injected fuel towards the area of the respective spark-forming zone, in the gap between the spark plug electrodes.

4. A device as claimed in claim 3, wherein the plane of the valves, i.e. the sliding plane between the valve ring (28) and the port ring and thus the injection nozzle (62) is positioned adjacent the associated spark plug electrodes in a space (25) above the piston heads.

5. A device as claimed in claim 3 wherein, the infection nozle (62) is directed substantially in parallel with the axial direction of the rotor.

6. A device as claimed in claim 2, wherein the engine is spark plug engine having spark plugs arranged on the rotor, wherein the injection nozzle is arrange to direct the injects fuel towards the area of the respective spark-forming zone.

7. A device as claimed in claim 4, wherein the injection nozzle is directed substantially in parallel with the axial direction of the rotor.

8. A device as claimed in claim 6, wherein said spark forming zone is in the gap between the spark plug electrodes.

* * * * *